United States Patent [19]

Reverberi

[11] 3,981,026

[45] Sept. 21, 1976

[54] WATERPROOF GARMENT OF REDUCED CUMBERSOMENESS

[76] Inventor: Leo Reverberi, 5, Passage de la Main d'Or, 75011 Paris, France

[22] Filed: Jan. 9, 1975

[21] Appl. No.: 539,844

[30] Foreign Application Priority Data

Aug. 30, 1974 France ..... 74.29601

[52] U.S. Cl. ..... 2/1; 2/82; 2/87; 2/301; 2/338

[51] Int. Cl.[2] ..... A41D 15/00

[58] Field of Search ..... 2/82, 84, 85, 87, 88, 2/93, 247, 301, 338, 17

[56] References Cited

UNITED STATES PATENTS

| | | | |
|---|---|---|---|
| 2,142,814 | 1/1939 | Fitch | 2/93 |
| 2,143,931 | 1/1939 | Aronson | 2/93 |
| 2,319,983 | 5/1943 | Furman | 2/88 X |
| 2,325,494 | 7/1943 | Fayer | 2/93 |
| 2,412,415 | 12/1946 | Navon | 2/84 |
| 2,971,198 | 2/1961 | Tomich | 2/84 |
| 3,042,931 | 7/1962 | Sawyer | 2/84 X |
| 3,161,887 | 12/1964 | Silver | 2/88 |
| 3,670,340 | 6/1972 | Walker | 2/93 |

FOREIGN PATENTS OR APPLICATIONS

| | | | |
|---|---|---|---|
| 1,137,127 | 1/1957 | France | 2/87 |

*Primary Examiner*—Werner H. Schroeder
*Assistant Examiner*—Moshe I. Cohen
*Attorney, Agent, or Firm*—Haseltine, Lake & Waters

[57] ABSTRACT

This invention concerns a waterproof garment for protection against rain made from a waterproof sheet material which garment consists of an assembly of preformed, permanent, parallel folds which when gathered give the garment the appearance of a band the final width of which is substantially the same as the width of a belt.

5 Claims, 9 Drawing Figures

20
25
26
27
28
29
30
31
32
33
34
35
36
37
3
4
L
2L

WATERPROOF GARMENT OF REDUCED CUMBERSOMENESS

This invention concerns a waterproof garment of reduced cumbersomeness, which can be carried in fine weather without any constraint.

The term "waterproof garment" should not be construed as limiting the invention, it should be understood that it refers to any kind of garment capable of being made from sheet material, preferably plastics, and destined to be worn over the usual garments as a means of protection against rain or other precipitation. By way of example and without any limitative intention, one may mention the following waterproof garments that can be made according to the invention: short jackets, coats, cloaks, lumber-jacket, trousers, sou'wester hats, capes, etc.; these garments may or may not be provided with a hood for protecting the user's head.

The principal aim of the invention is to achieve a waterproof garment of any kind from a plastic sheet material which, when not used against rain, may be worn by the user without encumbering his hands or arms, and without bulging his pockets.

This aim is achieved according to the invention by providing a waterproof garment of plastic material which presents an assembly of permanent, parallel folds permitting, when the folds are gathered, the garment to assume the appearance of a band the width of which is generally equal to that of a belt.

The waterproof garment of this invention is preferably provided with appropriate closure means capable of maintaining the waterproof garment in its state folded into a band and with closure means for keeping this band closed around the user's body, like a belt.

Preferably, the permanent folds of the waterproof garment are disposed substantially symmetrically on either side of a central fold coinciding with the general axis of symmetry of the garment. Advantageously, the fold lines nearer the central fold are mutually spaced by a distance equal to twice the final width of the belt, and the successive fold lines up to the edge of the garment are separated from each other by a distance shorter than this final width.

Preferably also the closure means for maintaining the waterproof garment in the folded state consist of mutually complementary elements respectively disposed along the length of the lines of fold adjacent the central fold, on the outside of these lines.

Figure 2:
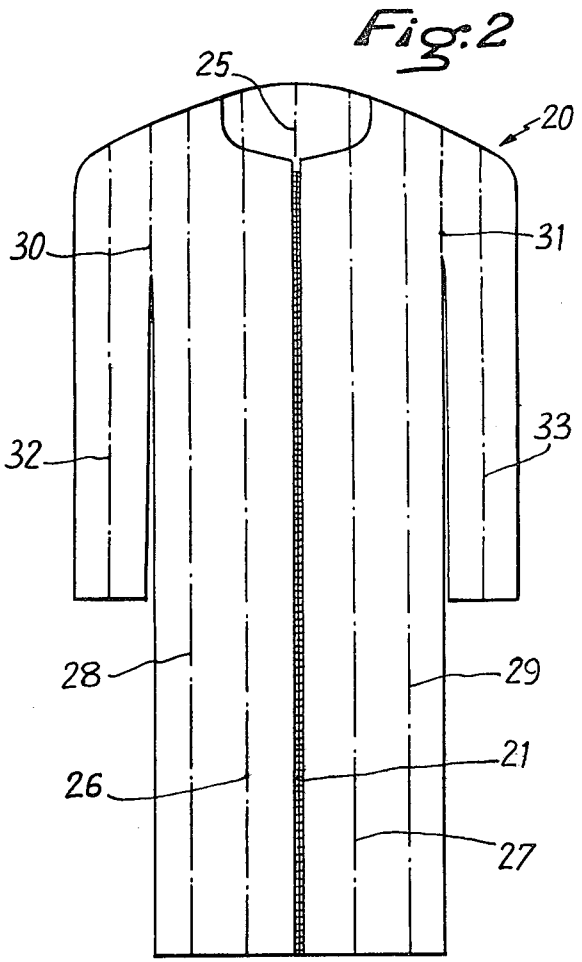
Figure 1:
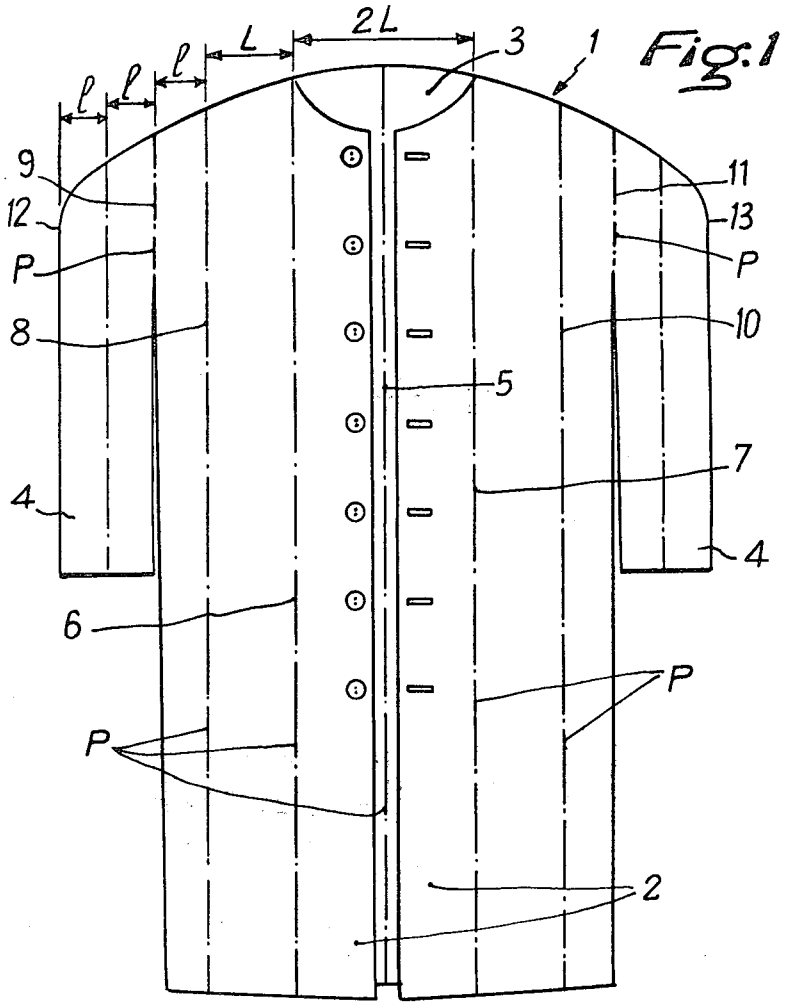
Figures 3, 4, 5, 6:
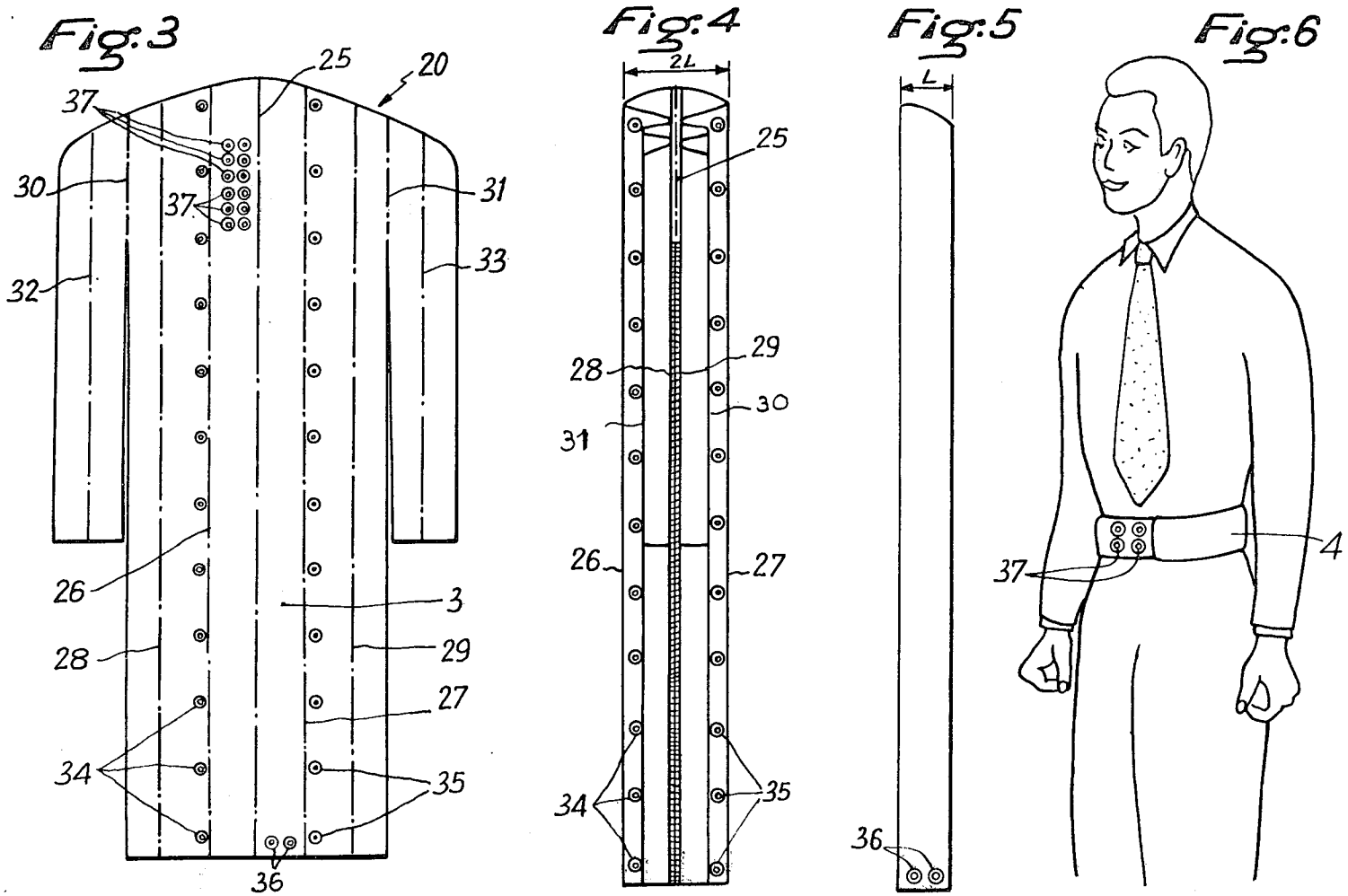
Figure 9:
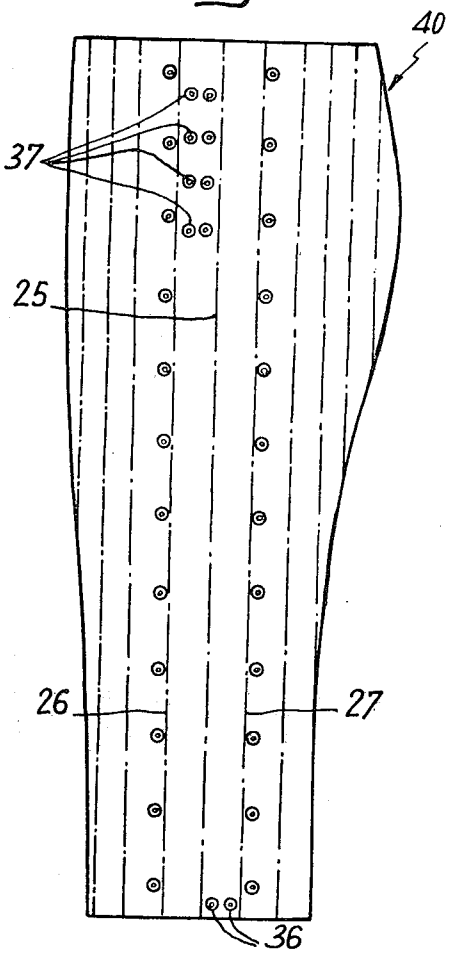
Figure 8:
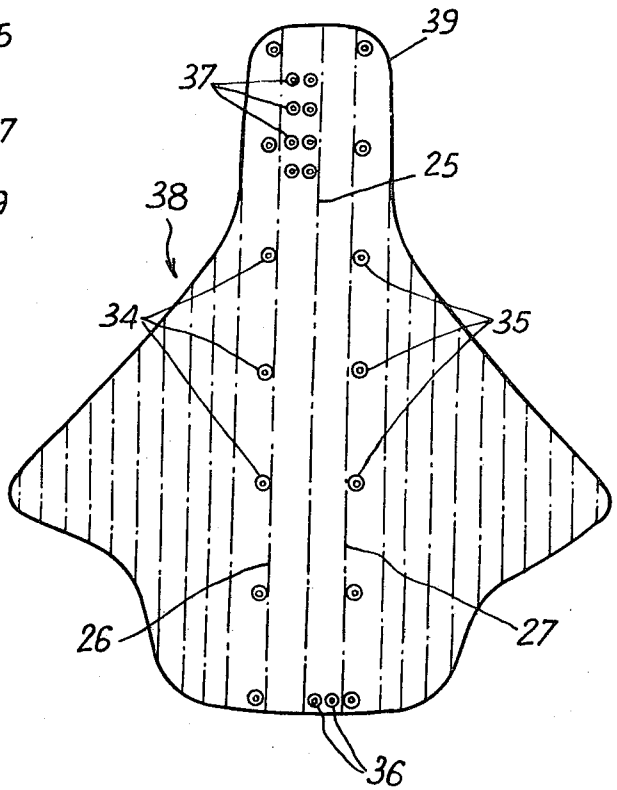
Figure 7:
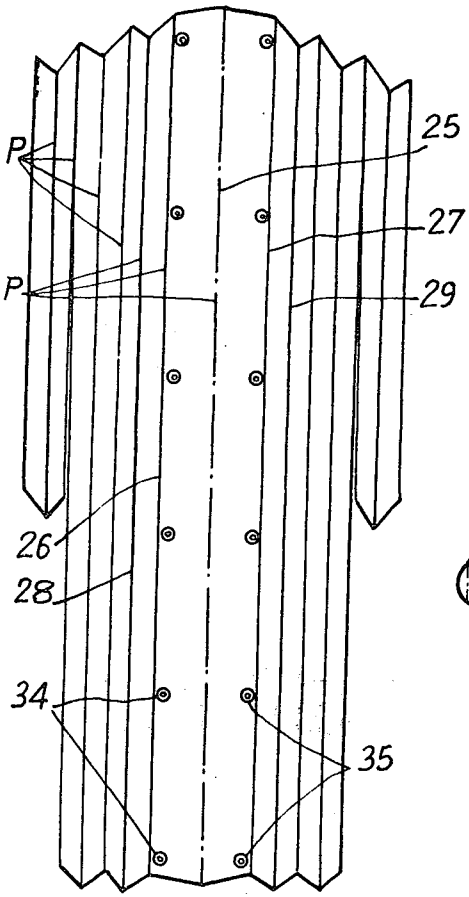

In order to better explain the invention, a description of a number of embodiments thereof will now be given by way of example only with reference to the accompanying drawings, wherein:

FIG. 1 is a general elevational view of a waterproof coat made of a plastic material according to the invention and in its open state, FIGS. 2 and 3 respectively show the front and the back of another waterproof coat of plastic material according to the invention in a flat state, FIG. 4 shows the coat of FIGS. 2 and 3 refolded according to the invention, FIG. 5 shows the folded coat of FIG. 4 re-closed over itself to constitute a belt, FIG. 6 shows the belt of FIG. 5 worn by a user, FIG. 7 shows another waterproof garment according to the invention in the course of folding, and FIGS. 8 and 9 are views showing two other garments according to the invention, being respectively a cyclist's hooded cape and a pair of trousers, shown flat.

Referring first to FIG. 1, there is shown a protective raincoat with sleeves which closes at the front by means of buttons and buttonholes.

As is known, this coat 1 has a front 2 and a back 3 which may be made separately with half the sleeves 4 and then united to each other by any known and appropriate method, e.g. welding.

According to the invention the coat 1 is made from a plastics sheet material chosen so that it should be capable of being marked with permanent fold lines. For a man skilled in the art there is no difficulty in selecting a suitable plastics material and then preforming it, e.g. by creasing with heat treatment, with ineffaceable fold lines.

To facilitate understanding, in the drawings the permanent lines P have been represented by chain lines. The lines P are visible on the garment and constitute, as on a pleated skirt, the beginnings of the folds that permit a reduction in the cumbersomeness or inconvenience of the garment, as will be explained below.

According to the invention the fold lines P are parallel in the longitudinal direction of the garment; they are effected symmetrically on either side of a central fold 5. The fold lines 6, 7 adjacent the central fold 5 are spaced from each other by a distance 2L equal to twice the final width L of the belt that is obtained from this garment.

According to a first aspect of the invention, the next successive lines 8, 9 on one side and 10, 11 on the other side may be spaced from each other by the same distance, equal to L. However, it is more expedient, according to a second aspect of the invention and for reasons given below, if the next successive fold lines 8, 10 are spaced from each other by a distance l which is shorter than the distance L. The lines after the lines 8, 10 are as numerous as is necessary for the garment in order to reach the edges 12, 13 of the garment so that the latter should be foldable from each of these edges 12, 13 by successive folds of width l.

When a garment according to the invention consists of two parts such as a front 2 and back 3, the folds or lines 5 to 11 are provided on the front and back so that they coincide when the garment is laid flat.

FIGS. 2 and 3 respectively show the front 2 and the back 3 of another coat 20 which may be closed at the front with the aid of a zip fastener 21. On this coat 20 the front 2 and the back 3 have, in alignment with each other respectively, a central fold 25, and folds 26 to 33 of which the two pairs of folds 26, 27 and 28, 29 nearer the central fold 25 are more widely interspaced that are the next successive folds 28, 30, 32 and 29, 31, 33.

On one of the faces of the waterproof garment of the invention, that is to say either on the front 2 or on the back 3, complementary closure elements are attached.

In the example described, complementary press stud elements 34, 35 are attached in alignment on the back 3 along the fold lines 26, 27 adjacent the central fold 25. It is to be noted that the press stud elements 34, 35 are located on the outside of the lines of fold 26, 27.

When the raincoat 20 is laid flat, as seen in FIG. 1, it is folded by starting at the folds 32, 33 adjacent the edges and farthest from the central fold 25. On each side the folds are closed one over the other until the folds 26, 27 are reached. When they have been folded in turn, the folded garment appears as shown in FIG. 4;

the press stud elements 34, 35 which were behind the plane of FIG. 2 are now to be found at the front (FIG. 4). These press stud elements 34, 35 are disposed in the space or gap between the fold lines 26, 27 adjacent the central fold 25 and the next successive folds.

The coat 20 is thus reduced to a band of width 2L. This band is then folded again along the central fold 25 and the associated press stud elements are closed. The coat 20 is transformed into a belt of width L (FIG. 5).

When the garment is made up as it is about to be described according to a second aspect of the invention, the resulting belt has two smooth, continuous exterior surfaces and all the folds of smaller width are contained in the interior of the belt.

When the garment is effected according to the first aspect of the invention, i.e. with all fold lines equally spaced by a width L, the complementary closure means 34, 35 are located along the fold lines 26, 27 nearest the central fold 25, but on the inside of these lines, as can be seen in FIG. 7. The waterproof coat of FIG. 7 is shown in the course of being folded; on this coat all the fold lines 26, 27, 28, 29 etc., are spaced by equal distances L which, however, cannot be appreciated due to the effect of the perspective view.

In this example, when the garment is folded and the closure means 34, 35 are interengaged, a belt is obtained but the folds are not contained in the inside of this belt, as will be understood from FIG. 7.

Nevertheless it is possible to wear this belt around the body, e.g. by enclosing it in an elongated sheath or case which may itself be closed around the user's body. However, it is evident that the thus obtained belt is less convenient to use than that of the more advanced second aspect of the invention.

Reverting now to FIGS. 2 to 6, it is to be noted that according to the second aspect of the invention the waterproof garment is provided with any suitable closure means for clasping it around the user's body when it has been folded into a belt, as shown in FIG. 6. These closure means may be constituted by a pair of closure elements 36 capable of interengagement with any one of several complementary pairs of elements 37, such as press studs.

On the coat 20 the closure elements 36 are attached to one end of the band between the central fold 25 and the fold line 27 while the closure elements 37 are attached to the opposite end of the band between the central line 25 and the fold line 26 (FIG. 3). Their disposition is such that it is easy to regulate the length of the belt (FIG. 6).

The invention is applicable to all kinds of garments. FIG. 8 shows a cyclist's cap 38 which is spread out and has a hood 39. FIG. 9 shows a pair of trousers 40 laid flat. It is considered unnecessary to describe these two garments in greater detail — they, too, have folds P consisting of the central fold 25; fold lines 26, 27 with closure elements 34, 35; and closure elements 36, 37.

The garment of the invention, such as the coat of FIGS. 1 and 2, 3 and 7 may be provided with a hood without interfering with the folding. It is sufficient that this hood should be foldable back on the coat laid flat and that it should have fold lines coinciding with those of the coat.

It is preferred that the fold lines be disposed symmetrically about the central fold 25 but this symmetry is not essential; it may be approximate only. Similarly, as can be seen from FIG. 9, it is not necessary for the waterproof garment according to the invention itself to extend symmetrically on either side of the central fold 25. In other words, it is preferable that the central fold 25 should coincide with an axis of symmetry of the garment but it may be spaced from this axis of symmetry by a greater or lesser extent.

I claim as my invention:

1. A waterproof garment for protection against rain made from thin, flexible waterproof material, having a longitudinal axis of symmetry and adapted to be folded into folds to assume the appearance of a band, wherein the folds are permanent and preformed parallel to one another, symmetrically with relation to a central fold which substantially coincides with said axis of symmetry, complementary closure means for the folded garment being located symmetrically along each of the two folds closest to the central fold, said means being spaced a distance from the central fold that is less than the spacing separating said central fold from each of the closest folds.

2. A waterproof garment for protection against rain made from thin, flexible waterproof material, having a longitudinal axis of symmetry and adapted to be folded into folds to assume the appearance of a band, wherein the folds are permanent and preformed parallel to one another, symmetrically with relation to a central fold which substantially coincides with said axis of symmetry, the two folds closest to the central fold being located a distance from said central fold greater than the spacing of the other folds from one another, complementary closure means for the folded garment being disposed symmetrically along each of the two folds closest to the central fold, said means being located at a distance from the central fold that is greater than the distance between the central fold and the closest folds.

3. The waterproof garment of claim 2, wherein the central fold and the two folds closest thereto define two symmetrical bands, an end portion of one of said bands being provided with closure means and the opposite end portion of the other of said bands being provided with complementary closure means, whereby when the garment is folded into a band, the closure means are adapted to close said band upon itself by its opposite end portions.

4. The waterproof garment of claim 1, having a front and a back, wherein the permanent, preformed folds in the front and the back coincide when the garment is laid flat.

5. The waterproof garment of claim 2, having a front and a back, wherein the permanent, preformed folds in the front and the back coincide when the garment is laid flat.

* * * * *